United States Patent [19]

Simm et al.

[11] Patent Number: 5,047,265

[45] Date of Patent: Sep. 10, 1991

[54] METHOD OF FLAME-SPRAYING OF POWDERED MATERIALS AND FLAME-SPRAYING APPARATUS FOR CARRYING OUT THAT METHOD

[75] Inventors: Wolfgang Simm, Ecublens; Hans-Theo Steine, Chavannes, both of Fed. Rep. of Germany

[73] Assignee: Castolin S.A., Switzerland

[21] Appl. No.: 342,341

[22] Filed: Apr. 24, 1989

[30] Foreign Application Priority Data

Apr. 28, 1988 [CH] Switzerland ..... 1599/88

[51] Int. Cl.[5] ..... B05B 1/24

[52] U.S. Cl. ..... 427/423; 239/13; 239/79; 239/80

[58] Field of Search ..... 427/423; 239/79, 80, 239/85, 13

[56] References Cited

U.S. PATENT DOCUMENTS

| | | | |
|---|---|---|---|
| 2,861,900 | 11/1958 | Smith et al. . | |
| 4,004,735 | 1/1977 | Zverev et al. | 239/79 |
| 4,370,538 | 1/1983 | Browning | 239/13 |
| 4,416,421 | 11/1983 | Browning | 239/79 |
| 4,805,836 | 2/1989 | Streb et al. | 239/80 |

FOREIGN PATENT DOCUMENTS

| | | | |
|---|---|---|---|
| 92143 | 4/1956 | Denmark | 239/79 |
| 135826 | 3/1985 | United Kingdom | 239/79 |
| 136978 | 4/1985 | United Kingdom | 239/79 |

*Primary Examiner*—Andres Kashnikow
*Assistant Examiner*—Christopher G. Trainor
*Attorney, Agent, or Firm*—Hopgood, Calimafde, Kalil, Blaustein & Judlowe

[57] ABSTRACT

A method is provided for flame-spraying powdered materials onto a substrate by means of an autogenous flame-spraying apparatus of the type in which a combustion gas-oxidation gas mixture is produced and ignited at the outlet of a burner nozzle with the powdered material conveyed by a carrier gas to the burner nozzle and introduced in the flame at the outlet of the burner nozzle. The working parameters of the flame-spraying apparatus are chosen so as to provide an energy constant $P_E$ which together with the kinetic energy $E_k$ of the particles enables the use of a broad range of flame speeds.

6 Claims, 4 Drawing Sheets

Figure 1:
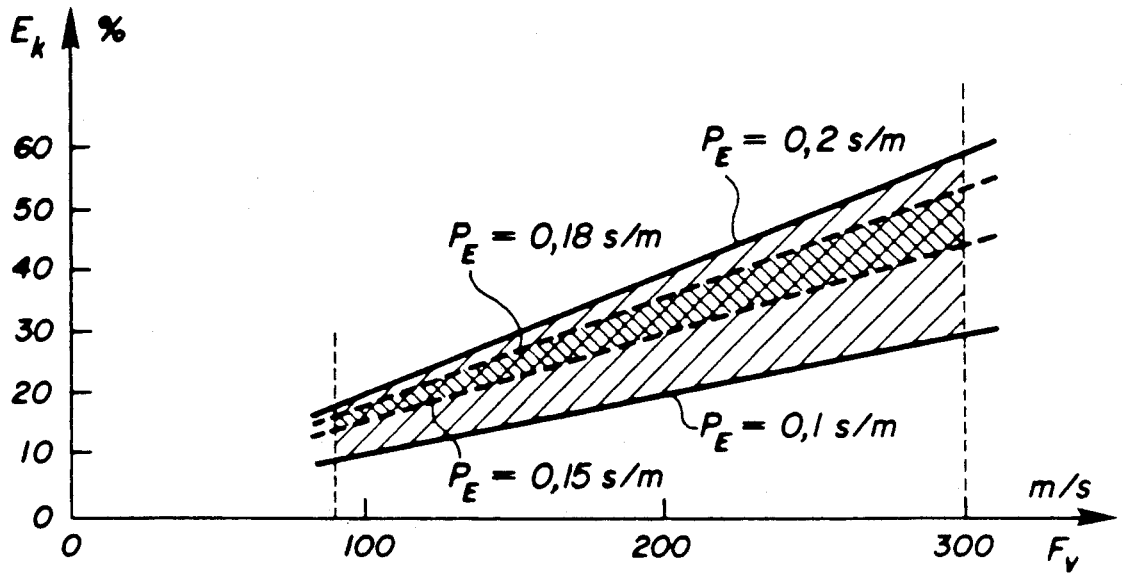

METHOD OF FLAME-SPRAYING OF POWDERED MATERIALS AND FLAME-SPRAYING APPARATUS FOR CARRYING OUT THAT METHOD

The present invention relates to a method of flame-spraying of powdered materials for producing surface layers on substrates by means of an autogeneous flame-spraying apparatus of the type in which a combustion gas - oxidation gas mixture is produced and ignited at the outlet of a burner nozzle and in which the powdered spraying material is conveyed by means of a carrier gas to said burner nozzle and introduced in the flame of the flame-spraying apparatus at the outlet of the burner nozzle.

Methods of this kind are known for a long time and have been studied in detail, in particular with a view to certain specific applications. Measures have been proposed, in particular, for obtaining a specific flame characteristic with the aim of improving the conditions of surface layer production and the quality of the layers produced. The corresponding methods and apparatuses were, however, very limited in their application and in the results achieved.

It is the main object of the present invention to provide a method of the above kind which allows to obtain optimum working conditions in the whole potential field of use of flame-spraying, i.e. for flame speeds ranging between 90 and 300 m/s and to reach, accordingly, the best possible results in respect of the applied layer. A further object of the invention is to provide such a method which can be carried out in a most economic way by reducing the need for multiple apparatuses and by simplifying the equipment. Another object of the invention is to provide a flame-spraying apparatus allowing to carry out the method of the invention in the whole range of the above mentioned flame speeds.

In accordance with the invention, the working parameters of a flame-spraying apparatus are chosen so that the energy constant $P_E$ of the particles of the spraying material is comprised between 0.1 and 0.2 s/m, said constant being defined by the ratio of the percentage of the kinetic energy $E_k$ of the particles to the total energy thereof at the impact of the particles on the substrate surface, to the flame speed $F_v$ measured in m/s. The output speed of the particles of spraying material at the burner nozzle, when the flame is burning, is less than 30 m/s according to the invention, and the grain size of the spraying material is chosen as a function of the flame speed within a continuously narrowing range comprised between 150 and 37 $\mu$m at $F_v$=90 m/s, and between 63 and 5 $\mu$m at $F_v$=300 m/s.

According to a preferred embodiment of the invention, the flame speed is increased with respect to the ignition speed of the combustion gas - oxidation gas mixture by means of a speed increasing extension part mounted on the flame-spraying apparatus.

The energy constant $P_E$ has preferably a value between 0.15 and 0.18 s/m. The output speed of the particles of spraying material at the burner nozzle, when the flame is burning, can be less than 10 m/s or greater than 15 m/s. The combustion gas is preferably supplied at a rate comprised between 500 and 3000 NL/h. NL means liter at normal condition i.e. atmospheric pressure at 20° C.

For carrying out the method of the invention, a flame-spraying apparatus is provided, wherein the combustion gas - oxidation gas mixture is produced by means of one or more injectors, arranged in a body part of the flame-spraying apparatus, in a nozzle supporting part exchangeably mounted between said body part and said burner nozzle, or in an exchangeable burner nozzle. Preferably, said exchangeable nozzle supporting parts or burner nozzles are provided with injectors which correspond to different flame energies, thus allowing to adapt the flame energy for a desired application by the choice of these nozzle supporting parts or burner nozzles.

The speed increasing extension part according to the invention is arranged adjacent the burner nozzle, said extension part comprising a combustion chamber and a substantially tubular acceleration part.

The acceleration part can have the same inner diameter at the flame inlet section as at the flame outlet section thereof, or it can have a conical inner shape with a greater diameter at the flame outlet section than at the flame inlet section. In another embodiment, the accelerating part is a venturi structure.

A preferred embodiment of the accelerating part has a staged structure, the inner diameter of which can be greater or smaller at the flame inlet section than at the flame outlet section.

An additional constriction gas jet can be introduced in the speed increasing extension part for constricting the flame. Such a constriction gas jet is preferably provided through lateral openings, for example at the level of the staging of the acceleration part. The constriction gas can be compressed air, nitrogen or an inert gas.

According to a further feature of the invention, a mounting device is provided which allows the mounting and exchanging of speed increasing extension parts on the flame-spraying apparatus for various dimensions of the burner nozzle or of a supporting part of the burner nozzle, and for various dimensions of said extension part. Such a mounting device can comprise connecting rings for adapting the outer diameter of the burner nozzle or of the corresponding supporting part to the inner diameter of the combustion chamber of the extension part. According to another embodiment, the mounting device is a clamping device or a hinged device, the latter allowing to turn away the extension part, for example when igniting the combustion gas - oxidation gas mixture.

Further objects, features and advantages of the invention will become apparent from the following description given by way of example, of the method of the invention and of various embodiments of a flame-spraying apparatus for carrying out the same. In the attached drawings, FIG. 1 is a diagram showing the working range in accordance with the method of the invention as a function of the kinetic energy of the particles and of the flame speed, FIG. 2 is a diagram showing the grain size distribution to be chosen as a function of the flame speed, and FIGS. 3 to 11 show various embodiments of a speed increasing extension part of a flame-spraying apparatus in accordance with the invention.

Extensive theoretical and practical preliminary studies have surprisingly led to the recognition that for reaching optimum conditions in flame-spraying for producing a layer as mentioned above, the ratio of the kinetic energy of the particles of spraying material to the total energy thereof, considered as a function of the flame speed, should be comprised within very narrow limits. The percentage of the kinetic energy $E_k$ with respect to the total energy of the particles upon their impact on the substrate, should be substantially proportional to the flame speed $F_v$, measured at the outlet of the burner nozzle, and the factor of proportionality which is here designated as energy constant $P_E$ should be in the range of 0.1 to 0.2 s/m. This has been represented in the diagram of FIG. 1, in which the range of flame-spraying extends from flame speed of 90 m/s, corresponding to the minimum ignition speed of the oxidation gas-combustion gas mixture, up to a flame speed of 300 m/s, which latter value is approximately the upper limit when means for accelerating the flame downstream the burner nozzle are being used. The energy of a particle of spraying material before its impact on the surface of the substrate is composed of its kinetic energy and its heat energy. The particle speed and the particle temperature can, for instance, be determined by means of a high-speed camera using infra-red film for temperature measuring. Since the mass of the individual particles of spraying material is known, the percentage of their kinetic energy with respect to their total energy can thus be determined. The flame speed is measured by usual means at the outlet of the burner nozzle.

The term "s/m" means seconds per meter, and the term "m/s" meters per second, one being the inverse of the other.

Figure 2:
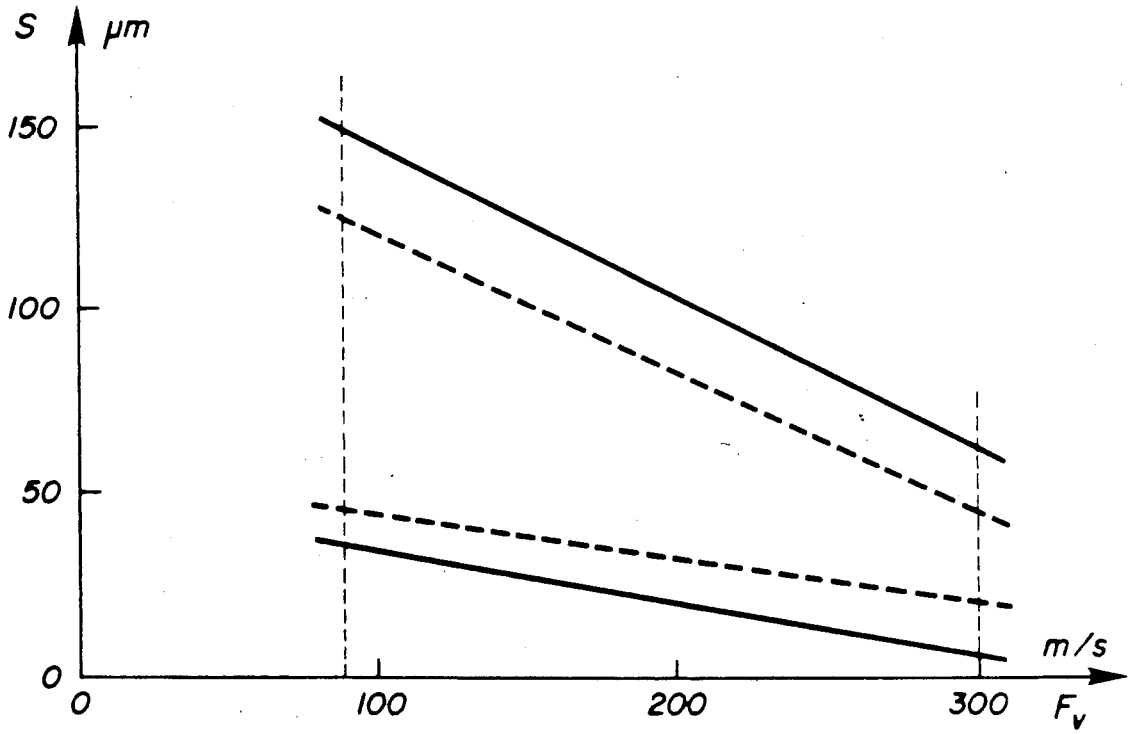

The diagram of FIG. 1 shows the present working range corresponding to energy constants between 0.1 and 0.2 s/m as an outer hatched area, and further shows an inner optimum range as an between dotted lines corresponding to energy constants of 0.15 and 0.18 s/m. The values defining the above areas are indicated in the following table:

| $P_E$ s/m | $F_v$ m/s | $E_K$ % |
|---|---|---|
| 0.1 | 90 | 9 |
| | 300 | 30 |
| 0.15 | 90 | 13.5 |
| | 300 | 45 |
| 0.18 | 90 | 16.2 |
| | 300 | 54 |
| 0.2 | 90 | 18 |
| | 300 | 60 |

FIG. 2 shows the ranges S to be chosen for the grain size of the particles of spraying material as a function of the flame speed. The range of grain sizes is continuously narrowing from a range comprised between 150 and 37 μm at a flame speed of 90 m/s, up to a range comprised between 63 and 5 μm at a speed of 300 m/s. The narrower range shown in FIG. 2 by dotted lines, in which the grain size is comprised between 125 and 45 μm at a flame speed of 90 m/s and between 45 and 20 μm at a flame speed of 300 m/s, constitutes an optimization of this parameter. In the present process, it is further of importance that the outlet speed of the particles of spraying material at the burner nozzle, when the flame is burning, is smaller than 30 m/s, this speed being preferably below 10 m/s without subsequent acceleration of the flame and is preferably in the range between 15 and 30 m/s when means for acceleration are used downstream the burner nozzle. The combustion gas is preferably supplied at a rate between 500 and 3000 NL/h.

For carrying out the present method, it is particularly advantageous to use a flame-spraying apparatus having a modular design, which means that it can be assembled from a plurality of constructional elements chosen to realize the above mentioned working conditions in each particular case of application. This allows, in particular, to work within the whole range which can be covered by flame-spraying, i.e. the range of flame speeds shown in FIGS. 1 and 2, with a minimum of required equipment.

Such a modular design of the flame-spraying apparatus allows, in particular, the exchange of various burner nozzles and/or nozzle supporting parts which are preferably provided with injectors for producing the combustion gas oxidation gas mixture, the arrangement and dimensioning of which correspond to a desired burner energy. Such injectors can also be provided in a body part of the flame-spraying apparatus. Among the other parts of the flame-spraying apparatus which are included in the modular structure thereof, are various powder supply devices and various gas supply units, which latter can be modular valve units corresponding to desired graded ranges of combustion gas supply rates. Furthermore, the modular elements of the flame-spraying apparatus comprise various speed increasing devices which are preferably cooled by water and which can be provided with a supply of constriction gas or be used without constriction gas, depending on the application.

Figure 3:
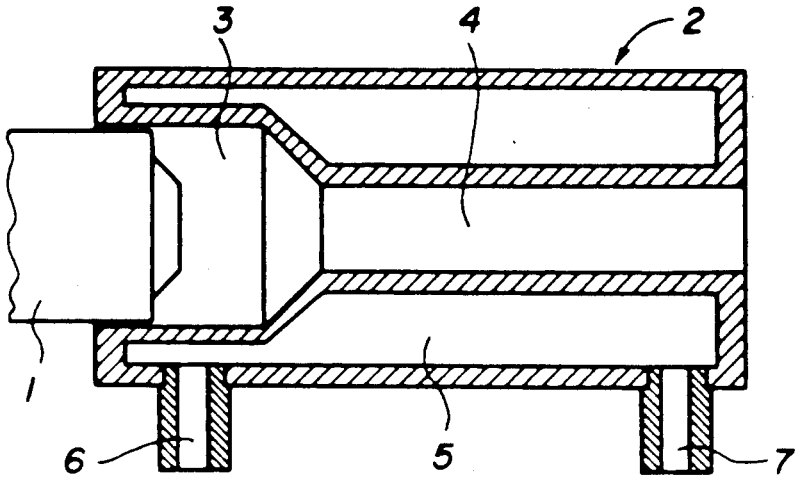
Figure 4:
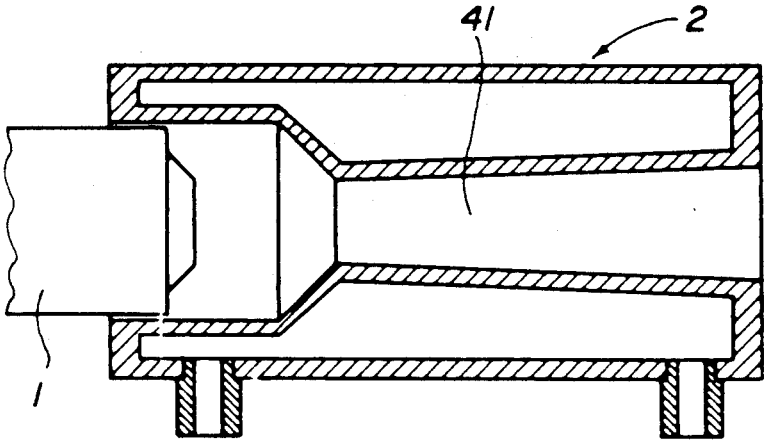
Figure 5:
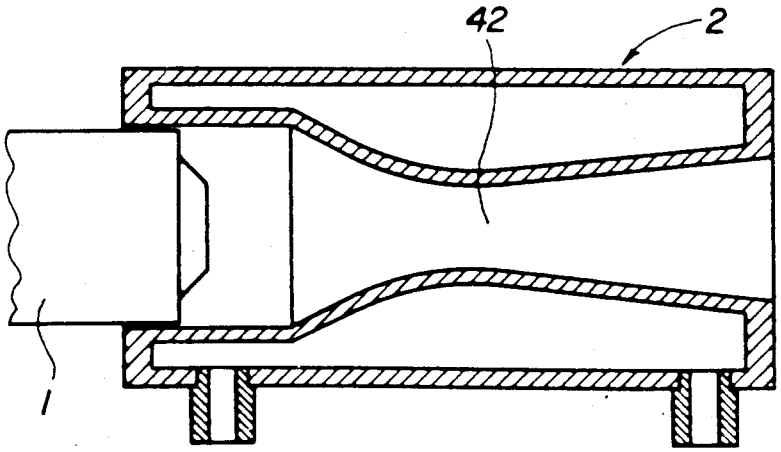
Figure 6:
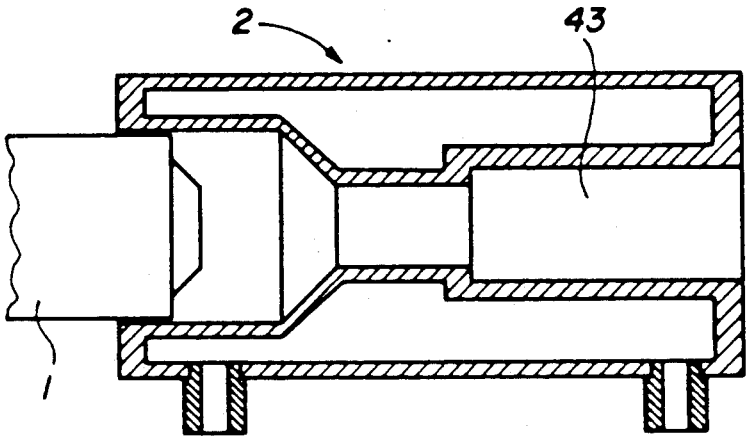
Figure 7:
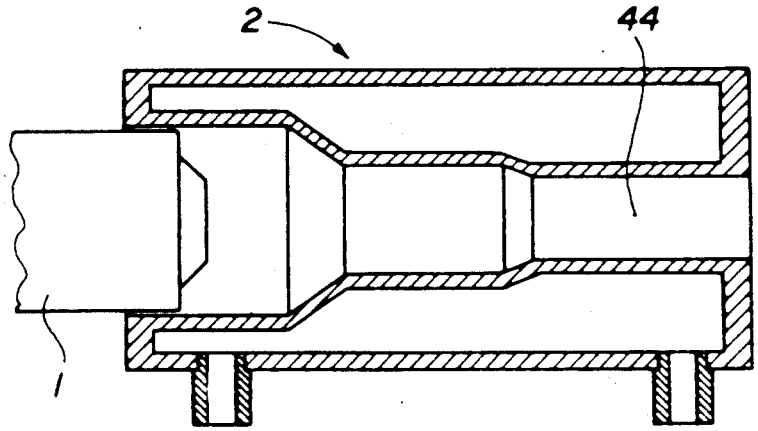
Figure 8:
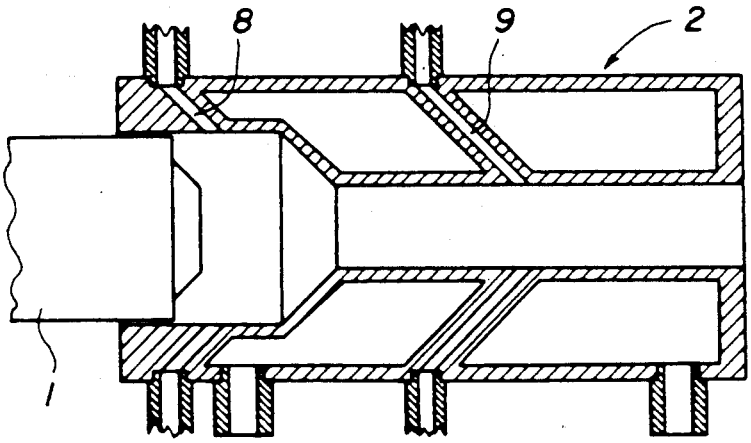
Figure 9:
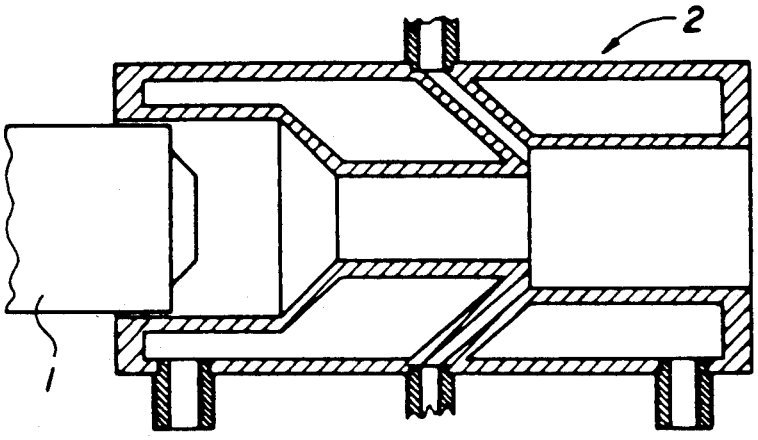
Figure 10:
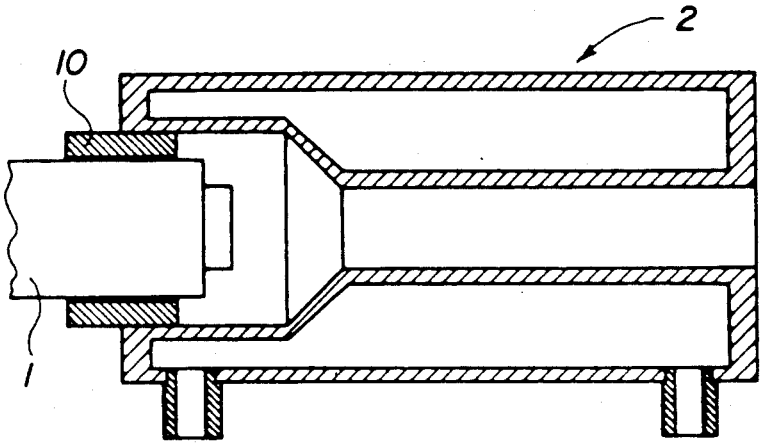
Figure 11:
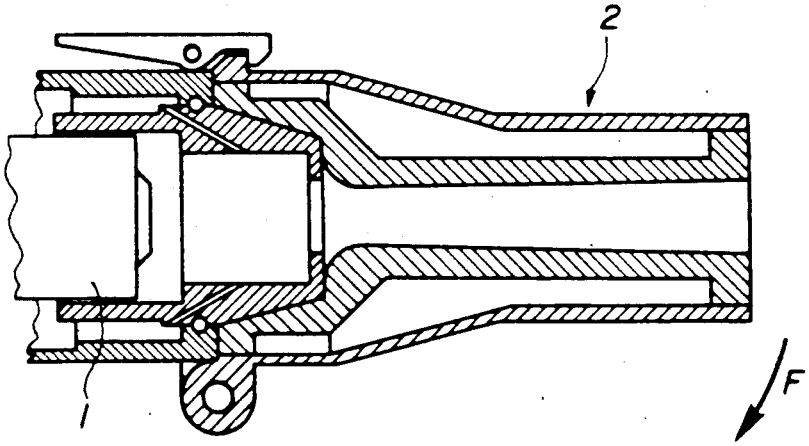

FIGS. 3 to 11 show various extension parts for increasing the flame speed which can be mounted on a burner nozzle or on a burner supporting part 1 by means of an appropriate mounting device, not shown in the schematic views of these figures. In particular, FIG. 3 shows an extension part 2, comprising a combustion chamber 3 as well as an adjacent acceleration part 4 of substantially tubular shape and constant inner diameter. The extension part is cooled by a medium such as water, and is therefore provided with a cooling chamber 5 having inlet and outlet openings 6,7 for the cooling medium. FIGS. 4, 5, 6 and 7 show, in a similar way, embodiments in which accelerating parts 41,42,43,44 have, respectively, a conical inner shape, the shape of a venturi and a staged tubular shape, with increasing or decreasing inner diameter. FIG. 8 shows an extension part in which a constriction gas is introduced over supply means 8 and 9, respectively to the combustion chamber and to the acceleration part. It is understood that also only either one of the supplies can be used. FIG. 9 shows the supply of a constriction gas to the staged portion of an extension part. FIG. 10 shows, schematically, the mounting of a speed increasing extension part onto a burner nozzle of smaller diameter by means of a connection ring 10. FIG. 11 shows a hinged arrangement of the extension part, allowing to turn the same away in the direction of arrow F when the flame is to be ignited.

We claim:

1. A method of flame-spraying of powdered materials for producing surface layers on substrates by means of an autogeneous flame-spraying apparatus in which a mixture of a combustion gas and an oxidation gas is produced and ignited at the outlet from a burner nozzle, and in which the powdered spraying material is conveyed by means of a carrier gas to said burner nozzle and, at the outlet thereof, is introduced in the flame of the flame spraying apparatus, according to which method the working parameters of the flame-spraying apparatus are chosen so that the energy constant $P_E$ of the particles of the spraying material is comprised between 0.1 and 0.2 s/m, said constant being defined by the ratio of the percentage of the kinetic energy $E_k$ of the particles at the impact of the particles on the substrate surface, to the flame speed $F_v$ measured in m/s, the output speed of the particles of spraying material at the burner nozzle when the flame is burning being less than 30 m/s and the grain size of the spraying material being chosen as a function of the flame speed within a continuously narrowing range comprised between 150 and 37 μm at $F_v=90$ m/s and between 63 and 5 μm at $F_v=300$ m/s.

2. A method as claimed in claim 1, wherein the speed of the flame is increased with respect to the ignition speed of the combustion gas - oxidation gas mixture, by means of a speed increasing extension part mounted on the flame-spraying apparatus.

3. A method as claimed in claim 1 or 2, wherein the energy constant $P_E$ has a value between 0.15 and 0.18 s/m.

4. A method as claimed in claim 1, wherein the output speed of the particles of spraying material at the burner nozzle, when the flame is burning, is less than 10 m/s.

5. A method as claimed in claim 2, wherein the output speed of the particles of spraying material at the burner nozzle, when the flame is burning, is greater than 15 m/s.

6. A method as claimed in claim 1, wherein the combustion gas is supplied at a rate comprised between 500 and 3000 NL/h.

* * * * *